US011590378B2

(12) United States Patent
Thurman

(10) Patent No.: US 11,590,378 B2
(45) Date of Patent: Feb. 28, 2023

(54) EXERCISE CHAIR

(71) Applicant: Robert S. Thurman, Pleasanton, CA (US)

(72) Inventor: Robert S. Thurman, Pleasanton, CA (US)

( * ) Notice: Subject to any disclaimer, the term of this patent is extended or adjusted under 35 U.S.C. 154(b) by 83 days.

(21) Appl. No.: 17/212,644

(22) Filed: Mar. 25, 2021

(65) Prior Publication Data

US 2021/0299506 A1 Sep. 30, 2021

Related U.S. Application Data

(60) Provisional application No. 62/994,711, filed on Mar. 25, 2020.

(51) Int. Cl.

| | |
|---|---|
| ***A63B 21/04*** | (2006.01) |
| ***A47C 9/00*** | (2006.01) |
| ***A63B 21/02*** | (2006.01) |
| ***A63B 21/16*** | (2006.01) |
| ***A63B 21/00*** | (2006.01) |

(52) U.S. Cl.

CPC ..... *A63B 21/0442* (2013.01); *A47C 9/002* (2013.01); *A63B 21/023* (2013.01); *A63B 21/4045* (2015.10); *A63B 21/1609* (2015.10); *A63B 21/4027* (2015.10); *A63B 21/4047* (2015.10); *A63B 2208/0233* (2013.01); *A63B 2210/02* (2013.01)

(58) Field of Classification Search

CPC ..... A47C 3/025; A47C 3/30; A47C 3/004; A47C 9/002; A63B 21/023; A63B 21/0442; A63B 21/4045; A63B 21/00047; A63B 21/00058; A63B 21/00061; A63B 21/00065; A63B 21/00178; A63B 21/00185; A63B 21/02; A63B 21/025; A63B 21/04; A63B 21/0407; A63B 21/0421; A63B 21/0428; A63B 21/4035; A63B 21/1609; A63B 21/4027; A63B 2208/0233; A63B 2210/02; A63B 23/0205; A63B 23/0211; A63B 23/0233; A63B 23/0238; A63B 26/003

See application file for complete search history.

(56) References Cited

U.S. PATENT DOCUMENTS

| | | | |
|---|---|---|---|
| 5,044,633 | A | 9/1991 | Rice |
| 6,390,960 | B1 | 5/2002 | Boland |
| 7,306,289 | B2 | 12/2007 | Kobayashi |
| 7,537,553 | B2 | 5/2009 | Mongelluzzo et al. |
| 7,635,323 | B2 | 12/2009 | Halbridge |
| 7,806,815 | B2 | 10/2010 | Fernandez et al. |
| 8,944,977 | B2 | 2/2015 | Foster et al. |
| 9,220,350 | B2 | 12/2015 | Best et al. |

(Continued)

FOREIGN PATENT DOCUMENTS

| | | |
|---|---|---|
| WO | 2011135462 A3 | 1/2012 |

*Primary Examiner* — Megan Anderson
(74) *Attorney, Agent, or Firm* — CrossPond Law

(57) ABSTRACT

An exercise chair allows a user to obtain physical exercise at his or her desk or other workplace. An exemplary exercise chair may include a frame, including a base, an angled section angled upward from the front of the base, and a back support extending upward from the rear of the base; a seat support rotatably connected to the angled section; and at least one resistance element connected to a rear portion of the seat support and to the back support.

20 Claims, 8 Drawing Sheets

(56) References Cited

U.S. PATENT DOCUMENTS

| | | | | |
|---|---|---|---|---|
| 10,455,947 | B2 | 10/2019 | Störiko | |
| 2002/0123414 | A1* | 9/2002 | Chen | A63B 23/0211 482/121 |
| 2002/0145321 | A1 | 10/2002 | Brightbill et al. | |
| 2009/0163336 | A1 | 6/2009 | Mueller | |
| 2018/0325759 | A1 | 11/2018 | Splane et al. | |
| 2018/0339181 | A1 | 11/2018 | Weisz | |
| 2019/0125609 | A1 | 5/2019 | Mason et al. | |
| 2021/0260431 | A1* | 8/2021 | Sakany | A63B 21/1609 |

* cited by examiner

EXERCISE CHAIR

CROSS-REFERENCE TO RELATED APPLICATIONS

This application claims the benefit of priority to U.S. Provisional Application No. 62/994,711, filed Mar. 25, 2020, which is hereby incorporated by reference in its entirety.

FIELD OF THE INVENTION

The invention generally relates to exercise equipment, and more particularly to exercise equipment usable in a home or office setting.

BACKGROUND

Americans and others generally do not get enough exercise, resulting in health problems such as obesity. Going to a gym or health club for exercise is difficult for some people, because they live too far away or are less mobile; others prefer not to go to the gym or health club for exercise for reasons such as shyness or self-consciousness. Further, gyms and health clubs may be closed by the government for prolonged periods of time to prevent or reduce the spread of communicable disease, such as the COVID-19 virus. Home exercise equipment does not solve this problem, because such equipment tends to be bulky, ugly, complicated to assemble and use, heavy, and expensive, and most people lack the space in their dwellings to dedicate to a home gym. These problems are multiplied in an office setting. Such equipment does not solve the problem of a lack of time to exercise. Thus, there is a need for home exercise equipment that is unobtrusive and simple to use in a normal home or office setting, in the course of daily life.

SUMMARY OF THE INVENTION

An exercise chair may include a base, at least one hinge, a seat rotatable about at least one hinge relative to a front edge of the base, an axle positioned in proximity to a rear edge of the seat, a back assembly attached to the base, the back assembly including an upper bar; and at least one resistance element detachably connected to the axle and to the upper bar.

A method of performing exercise using an exercise chair in conjunction with a workpiece work surface may include possessing an exercise chair that includes a base, at least one hinge, a seat rotatable about at least one hinge relative to a front edge of the base, an axle positioned in proximity to a rear edge of the seat, a back assembly attached to the base, the back assembly including an upper bar; and at least one resistance element detachably connected to the axle and to the upper bar; moving said exercise chair into proximity with the workpiece work surface; selecting at least one resistance element; connecting at least one resistance element to the exercise chair; sitting in the seat of the exercise chair; and exercising by moving the seat up and down, such that the axle alternately increases tension on at least one resistance element and decreases tension on at least one resistance element.

BRIEF DESCRIPTION OF THE DRAWINGS

The use of the same reference symbols in different figures indicates similar or identical items.

DETAILED DESCRIPTION

Figure 1:
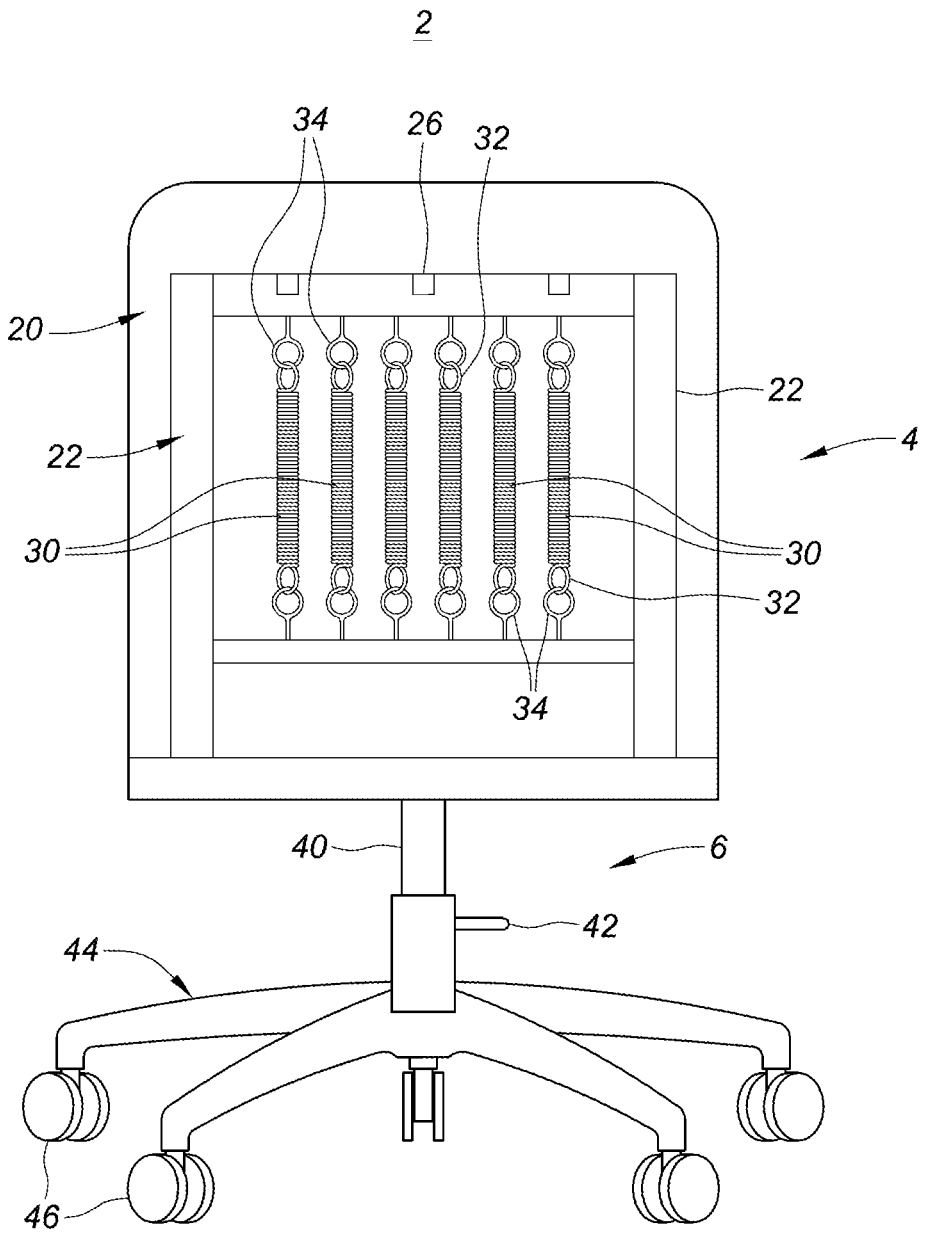
FIG. 1 is a front view of an exemplary exercise chair.
Figure 2:
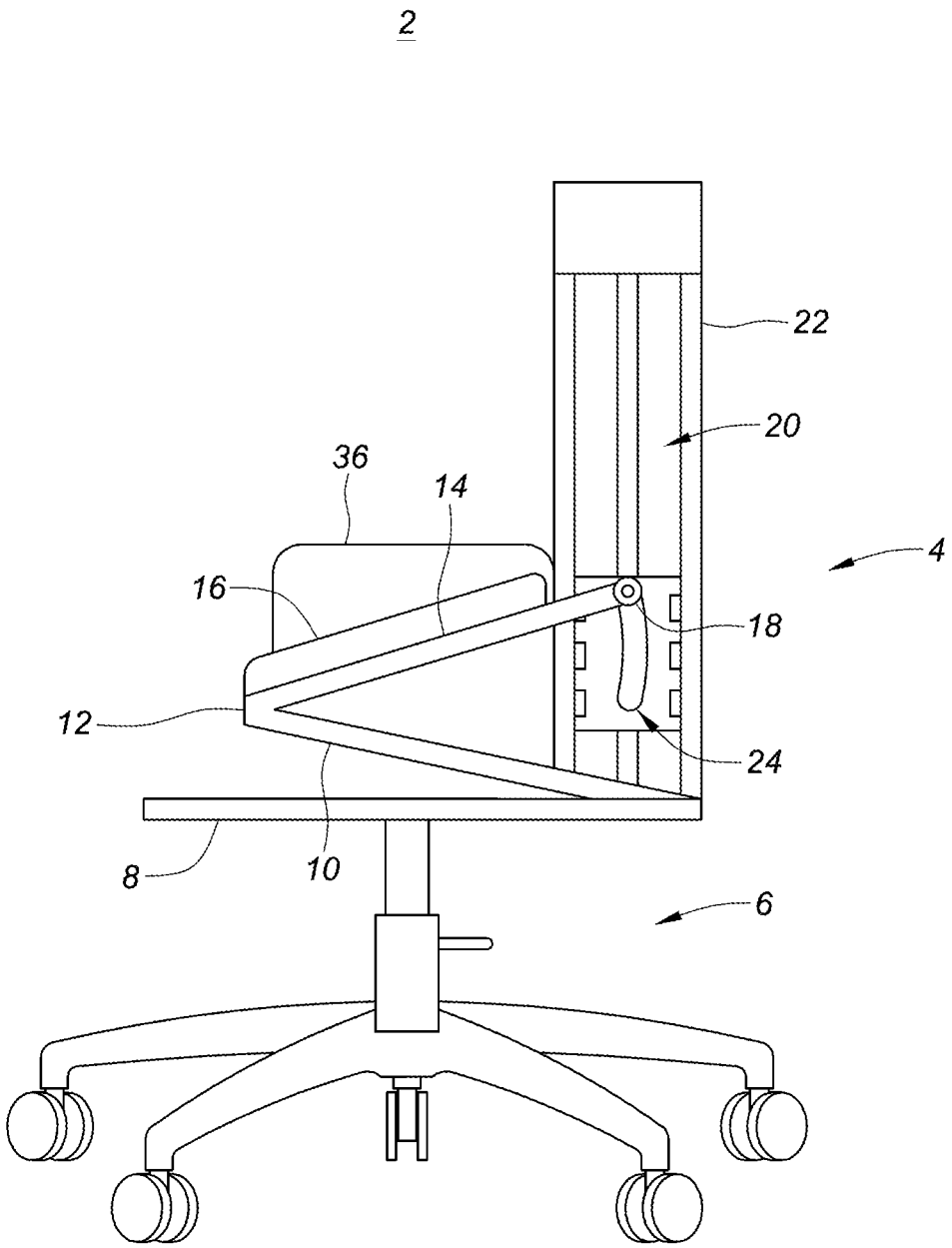
FIG. 2 is a side view of the exemplary exercise chair of FIG. 1.

Referring to FIGS. 1-2, an exercise chair 2 is shown. A seat assembly 4 is attached to a leg assembly 6. The seat assembly 4 may include a base 8 that is attached to the leg assembly 6. The base 8 may be fabricated from metal, such as steel or aluminum, or from any other suitable material. The base 8 may be affixed to the leg assembly 6 in any suitable manner, such as by screws, bolts, or welding, or may be detachably connected to the leg assembly 6. Advantageously, in use the base 8 is not substantially movable relative to the leg assembly 6. The base 8 may be generally square, or may have any other suitable shape.

Figure 3:
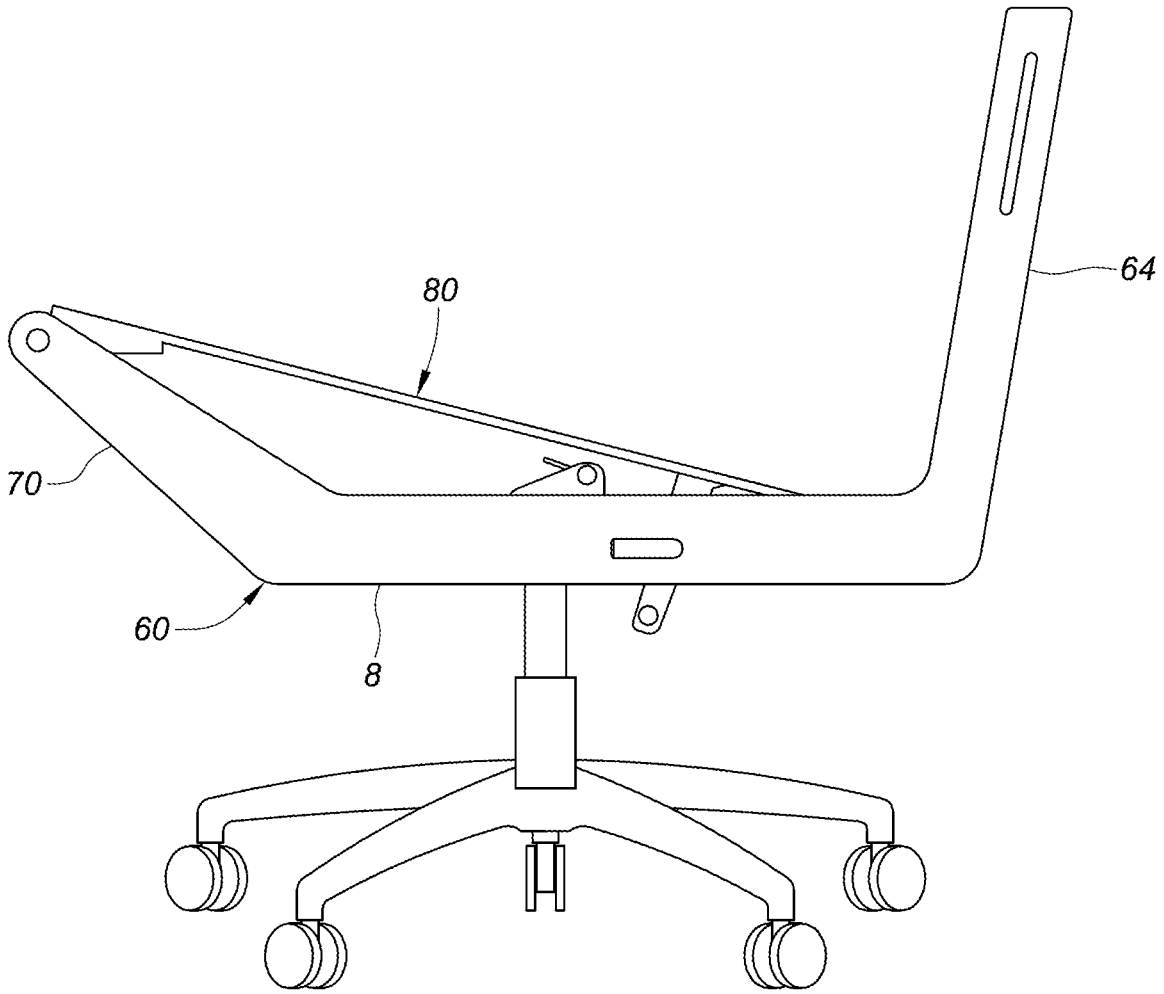
FIG. 3 is a side view of a frame and seat support of another exemplary exercise chair.
Figure 4:
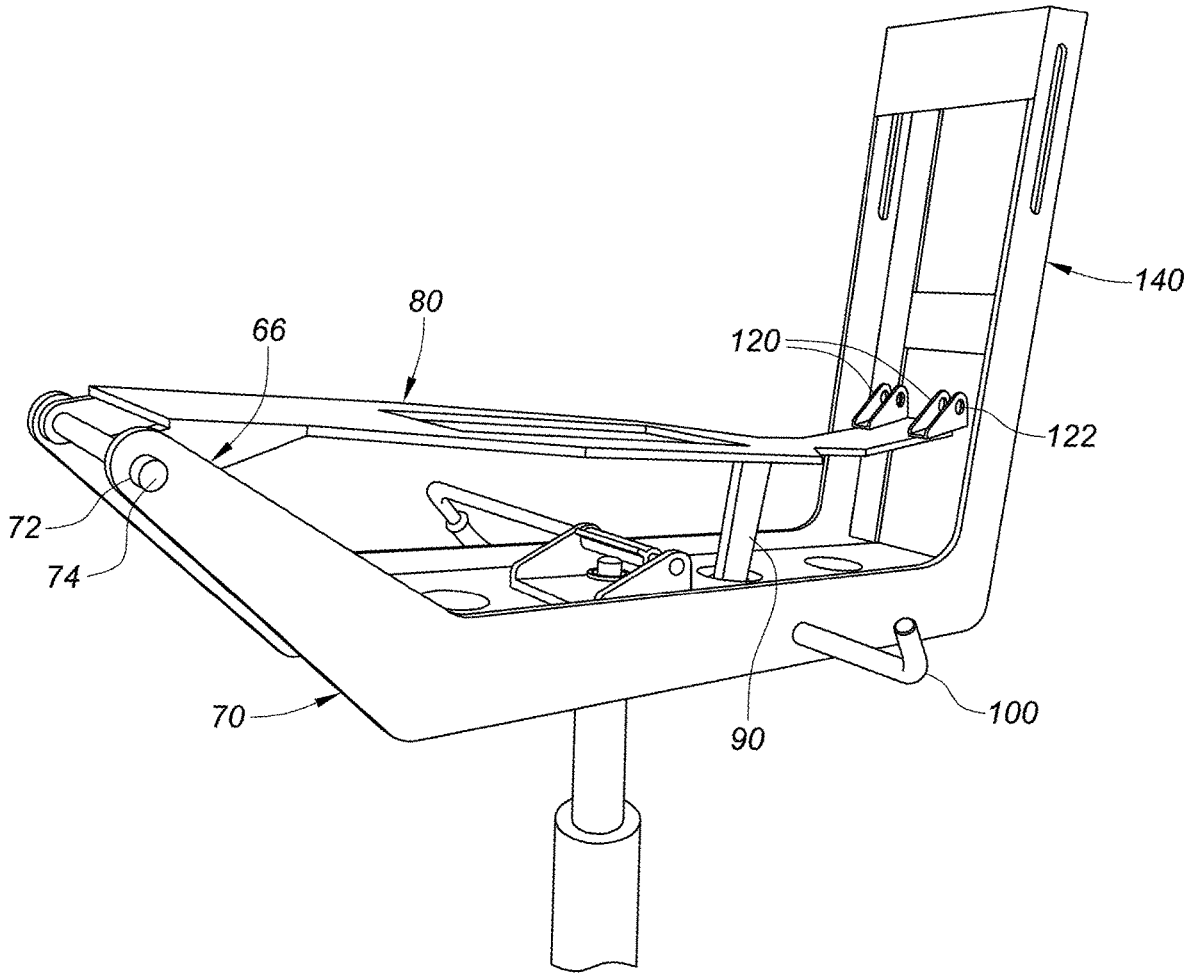
FIG. 4 is a perspective view of the frame and seat support of FIG. 3.

Referring to FIGS. 3-4, according to some embodiments, the base 8 is part of a frame 60. The base 8 may include two generally-vertical sidebars 66 laterally spaced apart from one another, connected by a generally-horizontal lateral piece 68. The lateral piece 68 may be connected to an upper edge of each sidebar 66, or may be connected to any other suitable location of each sidebar 66. The base 8 may be fabricated as an integral unit, or may be fabricated by welding or otherwise connecting the lateral piece 68 to one or both sidebars 66. A back support 64 may extend upward from the rear of the base 8, as described in greater detail below. A conventional seat control 89 may be connected to the frame 60, such as an upper surface of the frame 60, to allow the base 8 to move up and down, to tilt, or otherwise change its position or orientation.

The frame 60 may include a angled section 70 angled upward from the front of the base 8 toward the front of the frame 60. The angled section 70 may be a portion of the base 8, in which the sidebars 66 and/or lateral piece 68 extend upward toward the front of the frame. Alternately, the angled section 70 may be a separate piece that is welded or otherwise connected to the base. The angled section 70 includes one or more holes 72 defined therethrough, which may be in proximity to the front and top of the angled section 70. Where the angled section 70 includes the sidebars 66, each hole 72 is defined through a corresponding sidebar 66. A rod 74 may extend through the holes 72 and act as a hinge. The rod 74 may be fixed relative to one or both sidebars 66. Alternately, the rod 74 may be free to rotate relative to both sidebars 66. The rod 74 may be substantially fixed laterally relative to the sidebars 66, even if the rod 74 is free to rotate relative to the sidebars 66; in this way, the rod 74 is prevented from inadvertently sliding laterally out of one or both holes 72 in use.

Figure 6:
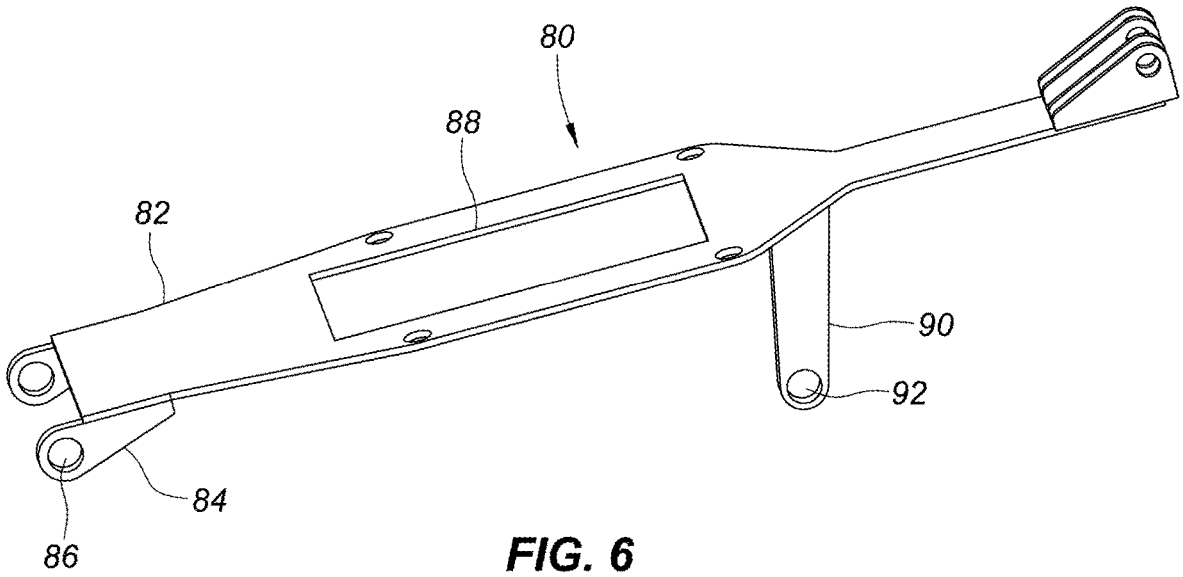
FIG. 6 is a perspective view of the seat support of FIG. 3.

Referring also to FIG. 6, a seat support 80 may be rotatably connected to the rod 74. The seat support 80 may include a generally-planar body 82. One or more flanges 84 may be located at or near the front of the body 82. Each flange 84 may extend from and generally perpendicular to the body 82. Alternately, one or more flanges 84 may be positioned at a different angle relative to the body 82. Each flange 84 may extend from a lateral edge of the body 82. Alternately, one or more flanges 84 may extend from a different part of the body 82. Each flange 84 may include a hole 86 defined therethrough. The holes 86 may receive the rod 74 therethrough. In this way, the body 82 is free to rotate about the axis of the rod 74. Where the rod 74 is fixed to the angled section 70, the body 82 is free to rotate about the rod 74 itself. Where the rod 74 is free to rotate relative to the angled section 70, the body 82 optionally may be welded to or otherwise affixed to the rod 74. A cushion 16 may be affixed to or placed on top of the seat support 80 for the comfort of the user.

Figure 5:
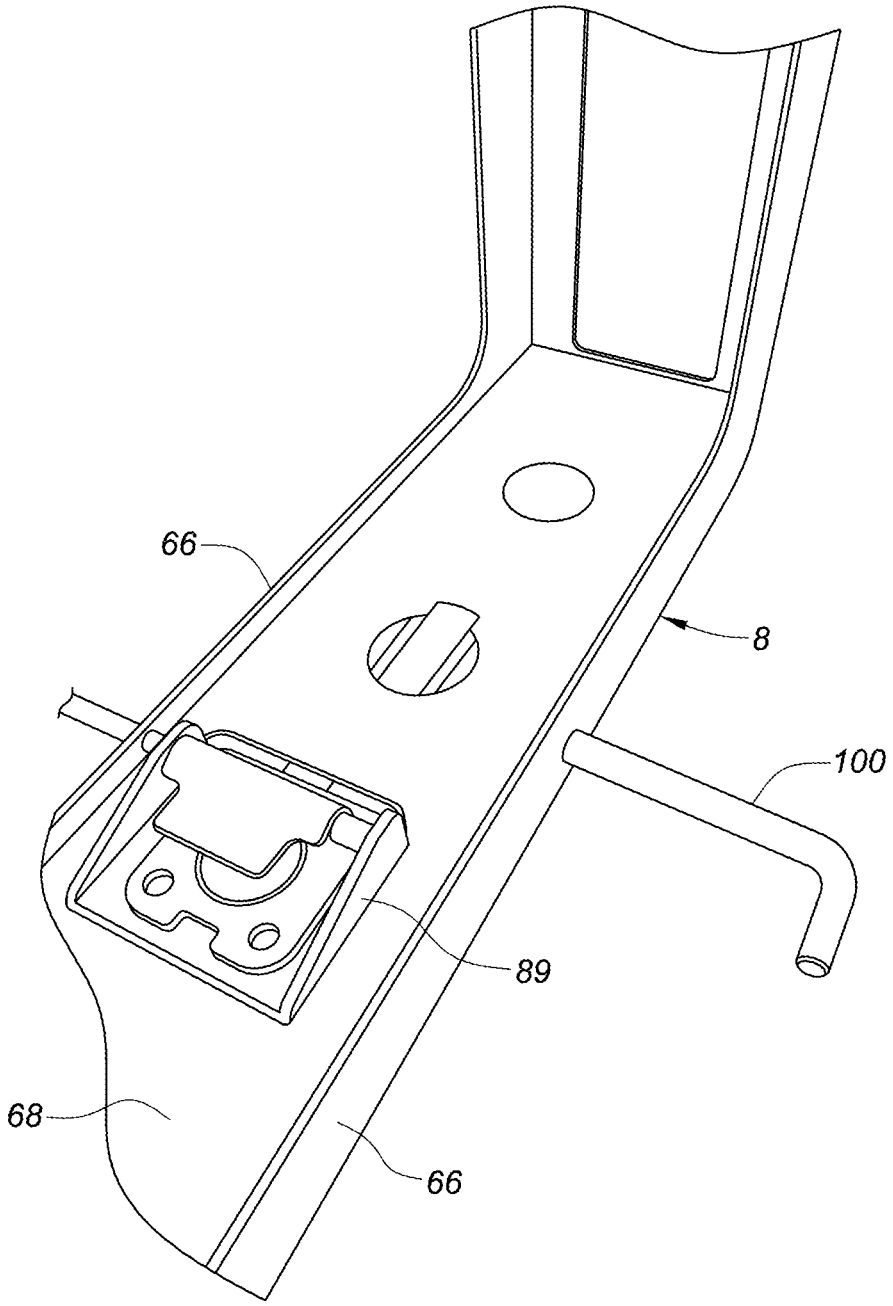
FIG. 5 is a perspective view of the frame of FIG. 3.

Referring also to FIG. 5, the body 82 may include an aperture 88 defined therethrough, in order to accommodate a seat control 89 when the body 82 is in a lower position, as described in greater detail below. The seat support 80 may include a post 90 extending downward from the body 82. The post 90 may be positioned behind the aperture 88 in the body 82. Alternately, the post 90 may extend downward from a different part of the body 82. The post 90 may be laterally narrower than its longitudinal dimension, or may be symmetrical in cross-section. A post hole 92 may be defined laterally through the post 90.

Figure 8:
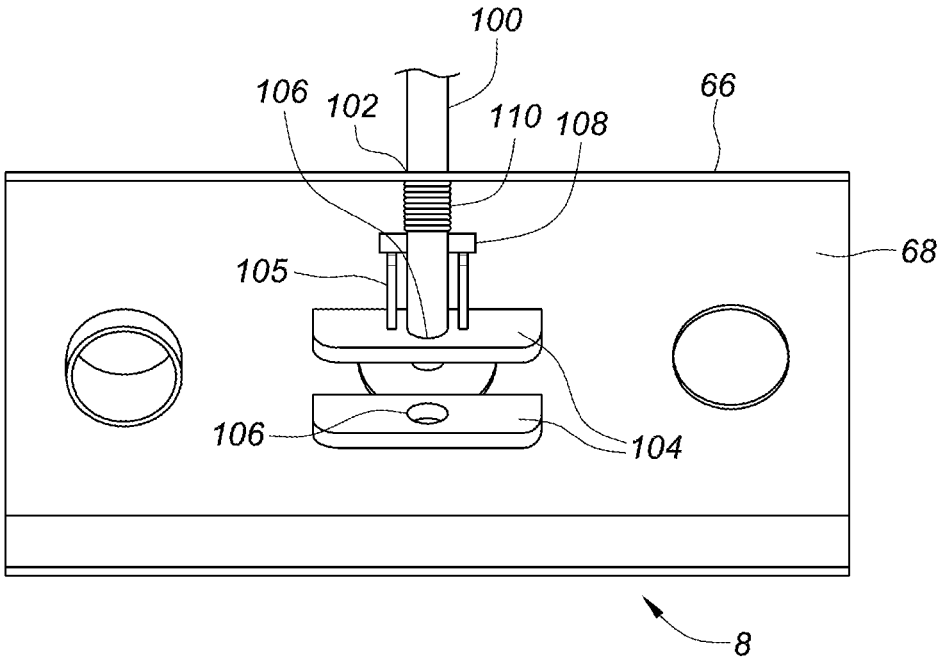
FIG. 8 is a bottom view of the frame of FIG. 3 with the pin in a first position.
Figure 9:
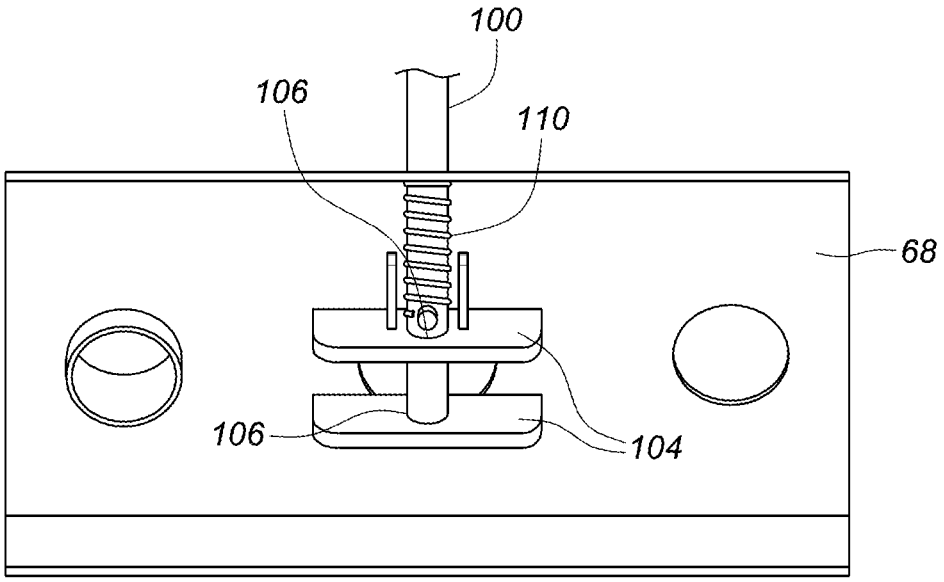
FIG. 9 is a bottom view of the frame of FIG. 3 with the pin in a second position.

Referring also to FIGS. 5 and 8-9, a pin 100 may be associated with the base 8 of the frame 60. The pin 100 is laterally movable relative to the base 8. A hole 102 may be defined through one of the sidebars 66, through which the pin 100 extends. Two lower flanges 104 may extend downward from the underside of the lateral piece 68. Each lower flange 104 may include a hole 106 defined therethrough. One lower flange 104 may include at least one side flange 105 extending laterally therefrom. The pin 100 may include a lateral pin 108 extending therefrom, where the lateral pin 108 is long enough to engage at least one side flange 105. A compression spring 110 may be positioned between the lateral pin 108 and the sidebar 66 closest to the lateral pin 108. The pin 100 is movable between a first position, in which the pin 100 is located outside of the holes 106, and a second position, in which the pin 100 extends through the holes 106. In the first position, the post 90 (and thus the seat support 80) is free to move relative to the base 8; in the second position, the post 90 (and thus the seat support 80) is locked in place relative to the base 8. Referring to FIG. 8, the pin 100 is in the first position. The lateral pin 108 is in contact with the lateral edge of at least one side flange 105. In the first position, the compression spring 110 is compressed between the lateral pin 108 and the sidebar 66. When the pin 100 is rotated by a user about the axis of the pin 100, the lateral pin 108 moves out of engagement with the lateral edge of at least one side flange 105, and the compression spring 110 pushes against the lateral pin 108 to move the pin 100 into the second position. Referring to FIG. 9, the pin 100 is in the second position, in which the pin 100 extends through the holes 106 defined through the lower flanges 104. The post hole 92 defined laterally through the post 90 is positioned between the holes 106 defined through the lower flanges 104 when the pin 100 moves to the second position. Thus, in the second position, the pin 100 extends through the post hole 92 as well as the holes 106 in the lower flanges 104. In this way, the pin 100 locks the post 90, and thus the seat support 80, relative to one another when the pin 100 is in the second position. Optionally, the post 90 may include two or more post holes 92, allowing the user to select from one of a plurality of positions of the seat support 80 to lock into position.

Figure 10:
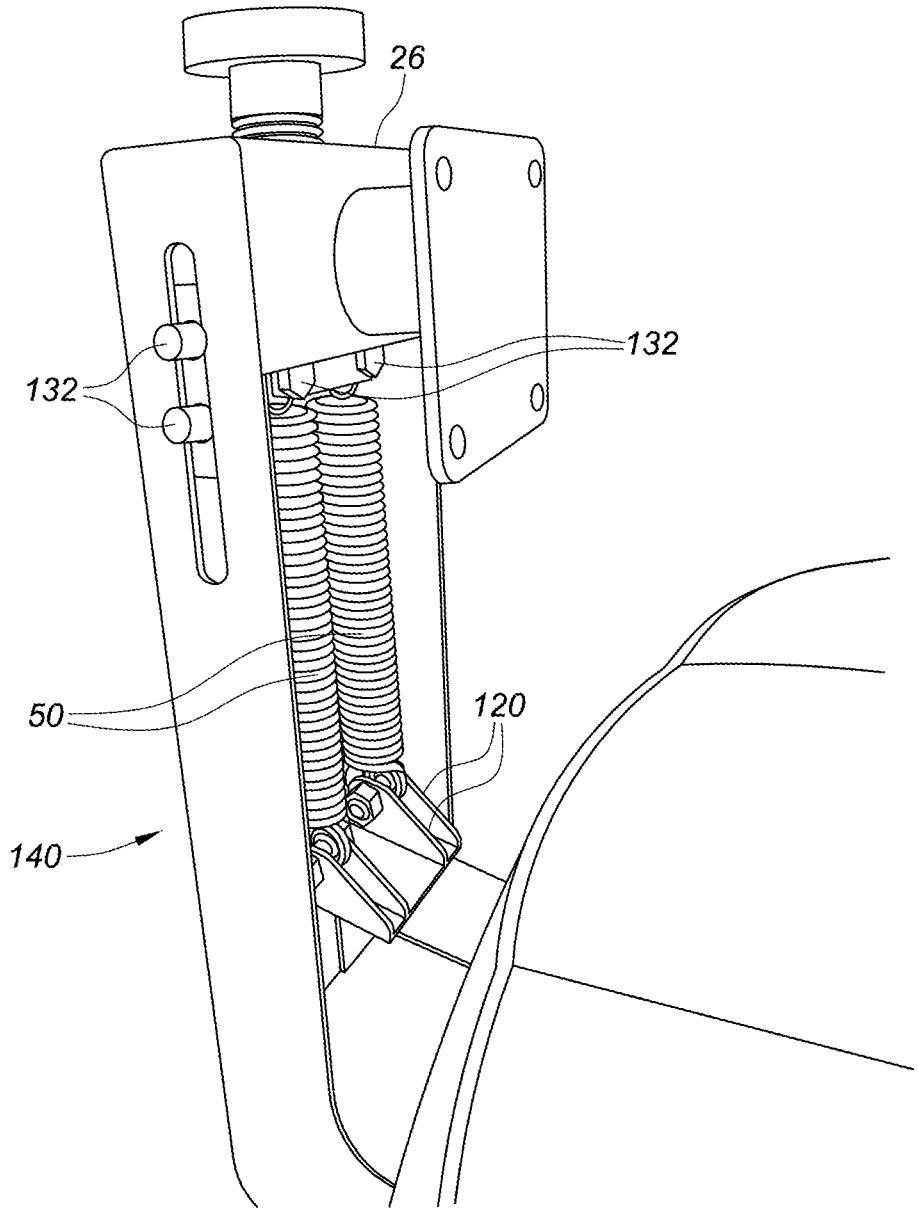
FIG. 10 is a perspective view of a back support of the exemplary exercise chair of FIG. 3.

Referring also to FIGS. 4 and 6, the rear of the body 82 of the seat support 80 may be laterally narrower than the front and/or middle sections of the body 82. One or more flanges 120 may be located at or near the rear of the body 82 of the seat support 80. Each flange 120 may extend from and generally perpendicular to the body 82. Alternately, one or more flanges 120 may be positioned at a different angle relative to the body 82. Each flange 120 may include a hole 122 defined therethrough. Four flanges 120 may extend from the body 82. Alternately, a different number of flanges 120 may extend from the body. Referring also to FIG. 10, a bolt 130 or rod may extend through the holes 122 of each adjacent pair of flanges 120. Thus, for example, where four flanges 120 are provided, two bolts 130 may be utilized. Alternately, a single bolt 130 or rod may extend through the holes 122 of all flanges 120. Alternately, a different number of bolts 130 or rods may be utilized.

Referring also to FIG. 10, the frame 60 may include a back support 140 extending upward from the rear of the base 8. The back support 140 may be a portion of the base 8, in which the sidebars 66 extend upward. The back support 140 may be generally perpendicular to the base 8, or may form any other ergonomically-suitable angle with the base 8. Alternately, the back support 140 may be a separate piece that is welded or otherwise connected to the base 8. An upper bar or assembly 26 may extend between and connect the sidebars 66 at or near the top of the back support 140 to provide rigidity for the frame 60. One or more rods 132 optionally may also extend between the sidebars 66. One or more bolts 134 may extend generally perpendicular to the upper bar 26 and/or the rods 132, and may be fixed relative to the upper bar 26 and/or the rods 132.

According to other embodiments, referring also to FIGS. 1-2, the seat assembly 4 may include an angled stop 10. The angled stop 10 may be connected to the base 8 at or near the rear end of the base 8, and may be angled upward relative to the base 8 toward the front of the base 8. The angled stop 10 may be angled at any suitable angle relative to the base 8. The angled stop 10 may be fixed relative to the base 8, or may be adjustable relative to the base 8 so that a user may adjust the angle of the angled stop 10 relative to the base 8 to his or her liking. In use, the angled stop 10 may be substantially fixed in place. At least one hinge 12 may be attached to the front edge or near the front edge of the angled stop 10. The hinge 12 may be a piano hinge, or may be any other suitable kind of hinge. The hinge 12 may be screwed or bolted to the angled stop 10, or may be connected to the angled stop 10 in any other suitable manner. According to other embodiments, the angled stop 10 may be omitted, and the hinge 12 may be attached to the front edge or near the front edge of the base 8. The seat assembly 4 may include a seat 14. At least one hinge 12 may be attached to the front edge or near the front edge of the seat 14. The hinge 12 may be screwed or bolted to the seat 14, or may be connected to the seat 14 in any other suitable manner. Alternately, the hinge 12 may be a living hinge that is integral with the seat 14 and/or the angled stop 10. In this way, the seat 14 may be hingeably connected to the angled stop 10. In this way, the seat 14 may rotate about the hinge 12, and thus rotate relative to the fixed angled stop 10. The seat 14 and the angled stop 10 may be fabricated from metal, such as steel or aluminum, or from any other suitable material. A cushion 16 may be affixed to or placed on top of the seat 14 for the comfort of the user.

According to some embodiments, an axle 18 may be attached to the rear edge or near the rear edge of the seat 14. Alternately, the axle 18 may be two separate pins, one at each lateral edge of the seat 14. The axle 18 may be generally cylindrical in shape, or may have any other suitable shape. The seat assembly 4 includes a back assembly 20, which in turn includes two lateral walls 22, one on each lateral side of the exercise chair 2. The lateral ends of the axle 18 may extend laterally outward from the lateral ends of the rear edge of the base 8. Each lateral end of the axle 18 may be received in a cam path 24 that is defined in, or through, each lateral wall 22. In this way, the cam path 24 holds the axle 18, restrains the axle 18 to a defined path of motion, and thereby restrains the seat 14 to a defined path of motion. The back assembly 20 also includes an upper bar 26 that extends between the lateral walls 22. The upper bar 26 may be connected to the upper end of each lateral wall 22, or may be connected to a location of each lateral wall 22 other than its upper end. Additionally, the upper bar 26 may extend laterally further than one or both lateral walls 22. The upper bar 26 may be fabricated integrally with the lateral walls 22, or may be fabricated separately and attached to the lateral walls 22 by fasteners, welding, or any other suitable mechanism or method.

Figure 7:
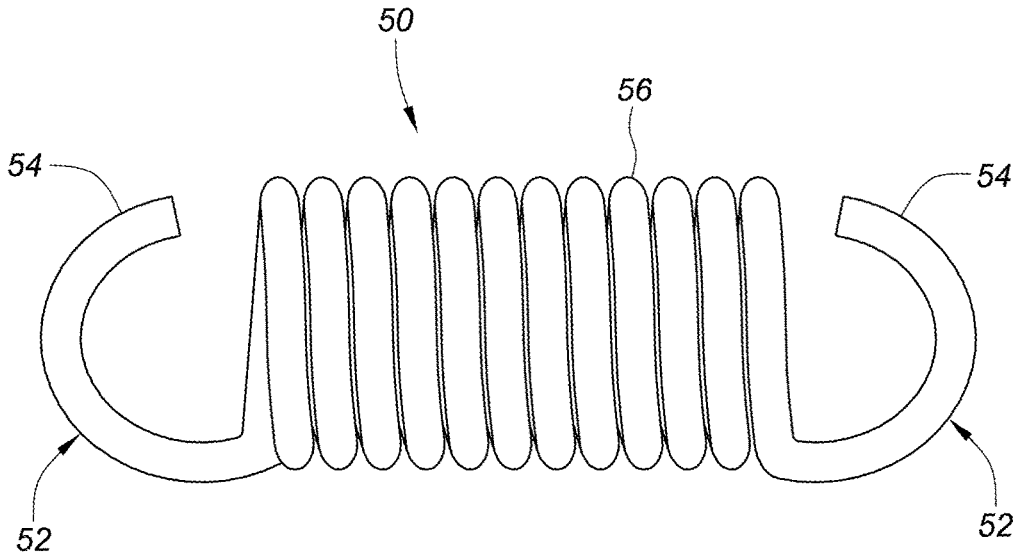
FIG. 7 is a side view of an embodiment of a resistance element that is a tension spring.

One or more resistance elements 30 are detachably connected to the upper bar 26 and to the axle 18. According to other embodiments, at least one resistance element 30 may be connected to a rear edge, or near the rear edge, of the seat 14 directly. The resistance elements 30 may be fabricated from any suitable elastic material, such as natural rubber, synthetic rubber, latex or other material. The term "resistance element" means any structure or mechanism that exerts tension when stretched, such as but not limited to tension springs, resistance bands, or bungee cords. Referring also to FIG. 7, the resistance elements 30 may be tension springs 50, due to their durability. The tension springs 50 may be fabricated from steel, stainless steel, or any other suitable material. The tension springs 50 may be standard coil springs, or may have any other suitable configuration that allows the spring to provide tension. Each tension spring 50 advantageously includes a hook 52 at each end thereof. Each hook 52 may be configured as a machine hook, a crossover hook, a side hook, or any other configuration in which a free end 54 is spaced apart from the coil 56 of the tension spring 50. The gap between the free end 54 of each hook 52 and the coil 56 of the tension spring 50 allows the user to change out tension springs 50 to increase or decrease resistance.

Referring also to FIGS. 4, 6, and 10, one end of at least one tension spring 50 may connect to the bolt 130 between adjacent flanges 120. The hook 52 of each tension spring 50 engages a corresponding bolt 130.

According to other embodiments, the hook 52 at one end of at least one tension spring 50 extends through at least one hole 122 defined through a flange 120, and the bolt 130 or rod is omitted. Where the flanges 120 are closely-spaced together, the hook 52 at one end of at least one tension spring 50 may extend through the holes 122 of adjacent flanges 120.

According to other embodiments, one or more tension springs 50 is permanently connected to a corresponding bolt 130 or flange 120. For example, in such embodiments there may be no hook 52 and thus no free end 54 of the hook and no gap between the free end of the hook and the coil 56. Instead of the hook 52, a loop or other closed structure may be defined at the end of the tension spring 50 such that the tension spring 50 cannot be removed from the corresponding bolt 130 or flange 120 without damaging or destroying the tension spring 50 or the corresponding bolt 130 or flange 120. While permanent connection of one or more tension springs 50 to a corresponding bolt 130 or flange 120 decreases the flexibility of the exercise chair 2, because the user cannot adjust resistance, such permanent connection simplifies the use of the exercise chair 2 and may simplify its manufacture.

Referring also to FIGS. 4, 6, and 10, one end of at least one tension spring 50 may connect to the bolt 132 associated with the rear section 140 of the frame 60; the hook 52 of each such tension spring 50 is detachably connected to a corresponding bolt 132. According to other embodiments, the hook 52 of at least one tension spring 50 is detachably connected to the upper bar 26. According to other embodiments, the hook 52 of at least one tension spring 50 is detachably connected to one or more of the rods 132.

According to other embodiments, one or more tension springs 50 is permanently connected to at least one of the corresponding bolt 132, upper bar 26 or rod 132. For example, in such embodiments there may be no hook 52 and thus no free end 54 of the hook and no gap between the free end of the hook and the coil 56. Instead of the hook 52, a closed loop or other closed structure may be defined at the end of the tension spring 50 such that the tension spring 50 cannot be removed from the corresponding bolt 132, upper bar 26 or rod 132 without damaging or destroying the tension spring 50 or the corresponding bolt 132, upper bar 26 or rod 132.

Referring also to FIGS. 1-2, the resistance elements 30 may be detachably connected to the upper bar 26 and the axle 18 by any suitable mechanism or method. As one example, each resistance element 30 may include a hook 32 at each end, and the upper bar 26 and axle 18 may include a plurality of loops 34 such as eyes that are affixed to the upper bar 26 and the axle 18. The hooks 32 on the resistance elements 30 may be connected to the loops 34 on the upper bar 26 and axle 18, thereby detachably connecting the resistance elements 30 to the upper bar 26 and the axle 18. As another example, each resistance element 30 may include a loop 34 at each end, and the upper bar 26 and axle 18 may include a plurality of hooks 32 that are affixed to the upper bar 26 and the axle 18. The loops 34 on the resistance elements 30 may be connected to the hooks 32 on the upper bar 26 and axle 18, thereby detachably connecting the resistance elements 30 to the upper bar 26 and the axle 18. As another example, any other types of detachable connection between the resistance elements 30 and the upper bar 26 and the axle 18 may be utilized. The resistance elements 30 each may have substantially the same resistance, or one or more resistance elements 30 may have a different resistance than one or more other resistance elements 30. The level of resistance provided to the user by the exercise chair 2 is controlled by changing the number and/or type of resistance elements 30, as described in greater detail below. Optionally, a release is provided that allows the user to release the tension provided by the resistance elements 30 without having to get up from the chair and manually disconnect all of the resistance elements 30. As one example, the release may be connected to the upper bar 26, and may move the upper bar 26 downward a sufficient distance to release the tension in the resistance elements 30.

The seat assembly 4 may include one or more arms 36. According to some embodiments, the arms 36 may be affixed to the base 8 of the seat assembly 4. According to some embodiments, the arms 36 may be affixed to a different part of the frame 60. The arms 36 may be located lateral to the seat 14, such that the seat 14 is rotatable about the angled stop 10 between the two arms 36. Optionally, the arms 36 may be omitted.

The leg assembly 6 may be a conventional leg assembly 6 found in conventional office chairs. The leg assembly 6 may include a leg 40 that is connected to or affixed to the base 8 of the seat assembly 4. Alternately, two or more legs 40 are provided and extend downward from the base 8 of the seat assembly 4. The leg 40 may be fixed in length, or may be telescoping to allow for comfortable seating by people of different heights. The seat height may be adjusted with the handle 42, as is standard in the art. The bottom end of the leg 40 may be connected to or received in a base 44. The base 44 may include a plurality of wheels 46 to facilitate motion of the user in the exercise chair 2. Alternately, the wheels 46 may be omitted. Alternately, the base 44 may be omitted, and a plurality of legs 40 may extend from the base 8 of the seat assembly 4 to the floor. The exercise chair 2 has a form factor and a level of comfort such that is it utilized in a home or office setting, such as at a desk. As such, it may look indistinguishable from a conventional office chair.

Operation

Operation of the exercise chair 2 will now be described. The user may utilize the chair in conjunction with a work surface at home or the office. The term "work surface" refers to a desk, table or other item that has a surface that can hold a laptop, computer, book or papers. For example, the user may utilize the chair at work at his or her desk. In this way, the user obtains the benefits of exercise with the chair while working, without the need to go to the gym or health club. The user selects a number and kind of resistance elements 30 corresponding to the desired amount of overall resistance. More resistance elements 30 increase the overall resistance. Where different kinds of resistance elements 30 are utilized, such that some resistance elements 30 provide more resistance that others, the user takes that into account when selecting an overall number of resistance elements 30 to utilize. The user connects the resistance elements 30, whether those resistance elements 30 are tension springs 50 or other structures or mechanisms, to the exercise chair 2 as described above. Alternately, where the resistance elements 30 are permanently connected to the exercise chair 2, the user does not select resistance elements 30 or connect them to the exercise chair 2. If the pin 100 is in the second position, in which the seat support 80 is substantially restrained against motion, the user moves the pin 100 to the first position in which the post 90 and thus the seat support 80 is free to move relative to the base 8.

The user then sits in the exercise chair 2, on the cushion 16, or directly on the seat support 80 if the seat support 80 is ergonomically fabricated to allow for such direct seating. Where the seat support 80 is fabricated to allow for direct seating, it may be referred to as the seat 14. Referring to FIGS. 3-10, the weight of the user causes the seat support 80 to pivot downward, about the axis of the rod 74. This pivot downward causes the rear of the body 82 of the seat support 80 to move downward. The upper end of each tension spring 50 is held substantially in place, such that the downward force exerted on the tension springs 50 stretches the tension springs 50. As a result, after the user has sat fully on the cushion 16 or seat support 80, the tension springs 50 store energy that attempts to shorten the tension springs 50, and that is exerted in a direction that pulls the user upwards. To use the exercise chair 2, the user may do several things. As one example, the user may move their buttocks upward, then push their buttocks downward against the resistance provided by the tension springs 50. The user may do so, for example, by rotating their knees, or by getting up slightly from the exercise chair 2 and then sitting down again. Such exercise would work the user's legs and/or core muscles. As another example, for arm exercise the user may grasp the arms 16 of the exercise chair 2 and pull or push downward against the cushion 16 or seat support 80, against the resistance of the tension springs 50. The user may grasp the undersides of the arms 16 of the exercise chair 2 to do so. In this way, this exercise would work the user's arm muscles. The user can continue to exercise at his or her discretion. When finished, the user may choose to lock the seat support 80 in place such that the exercise chair 2 acts as a standard chair. If so, the user rotates the pin 100 such that the lateral pin 108 moves out of engagement with the lateral edge of at least one side flange 105, and the compression spring 110 pushes against the lateral pin 108 to move the pin 100 into the second position, as described above. The pin 100 extends through the post hole 92 in the post 90 in the second position, thereby substantially preventing motion of the post 90 and thus the seat support 80 when the pin 100 is in the second position.

According to other embodiments, referring to FIGS. 1-2, the weight of the user causes the seat 14 to pivot about the hinge 12. As the seat 14 pivots, the axle 18 that is connected to the seat 14 moves downward in the cam path 24. That downward motion of the axle 18 exerts a downward force on the resistance elements 30 connected to the axle 18 or to the seat 14 in proximity to the axle 18. The upper end of each resistance element 30 is held substantially in place, such that the downward force exerted on the resistance elements 30 stretches the resistance elements 30. As a result, after the user has sat fully on the seat 14, the resistance elements 30 store energy that attempts to shorten the resistance elements 30, and that is exerted in a direction that pulls the user upwards. To use the exercise chair, the user may do several things. As one example, the user may move their buttocks upward, then push their buttocks downward against the resistance provided by the resistance elements 30. The user may do so by rotating their knees, or by getting up slightly from the exercise chair 2 and then sitting down again. Such exercise would work the user's legs and/or core muscles. As another example, for arm exercise the user may grasp the arms 16 of the exercise chair 2 and pull or push downward against the seat 14, against the resistance of the resistance elements 30. The user may grasp the undersides of the arms 16 of the exercise chair 2 to do so. In this way, this exercise would work the user's arm muscles. The user can continue to exercise at his or her discretion. When finished, the user optionally may actuate the release, if provided, to release the tension provided by the resistance elements 30.

As used in this document, both in the description and in the claims, and as customarily used in the art, the words "substantially," "approximately," and similar terms of approximation are used to account for manufacturing tolerances, manufacturing variations, manufacturing imprecisions, and measurement inaccuracy and imprecision that are inescapable parts of fabricating and operating any mechanism or structure in the physical world.

While the invention has been described in detail, it will be apparent to one skilled in the art that various changes and modifications can be made and equivalents employed, without departing from the present invention. It is to be understood that the invention is not limited to the details of construction, the arrangements of components, and/or the method set forth in the above description or illustrated in the drawings. Statements in the abstract of this document, and any summary statements in this document, are merely exemplary; they are not, and cannot be interpreted as, limiting the scope of the claims. Further, the figures are merely exemplary and not limiting. Topical headings and subheadings are for the convenience of the reader only. They should not and cannot be construed to have any substantive significance, meaning or interpretation, and should not and cannot be deemed to indicate that all of the information relating to any particular topic is to be found under or limited to any particular heading or subheading. Therefore, the invention is not to be restricted or limited except in accordance with the following claims and their legal equivalents.

What is claimed is:

1. An exercise chair, comprising:

a frame, comprising a base, an angled section angled upward from a front of said base, and a back support extending upward from a rear of said base;

a seat support rotatably connected to said angled section; and at least one resistance element connected to a rear portion of said seat support and to said back support.

2. The exercise chair of claim 1, wherein said seat support includes a base and a post extending downward from said base, wherein a post hole is defined through said base.

3. The exercise chair of claim 2, further comprising:

at least one lower flange extending downward from said base, said at least one lower flange including a hole defined therethrough, and a pin movable between a first position, in which said pin is located outside of said hole defined through each said at least one lower flange and outside of said post hole, and a second position, in which said pin extends through each said hole defined through each said at least one lower flange and through said post hole; wherein in said second position said pin locks said seat support relative to said frame.

4. The exercise chair of claim 3, further comprising a spring associated with said pin, wherein said spring biases said pin toward said second position.

5. The exercise chair of claim 4, further comprising at least one side flange extending from at least one lower flange, wherein said pin further comprises a lateral flange extending therefrom; and wherein in said first position said lateral pin contacts said at least one side flange to compress said spring and hold said pin in said first position.

6. The exercise chair of claim 1, wherein said seat support includes a base and a plurality of flanges extending upward from a rear end of said base.

7. The exercise chair of claim 6, further comprising at least one bolt connected to adjacent said flanges extending upward from said rear end of said base, wherein an end of said at least one said resistance element is connected to said at least one bolt.

8. The exercise chair of claim 6, wherein an end of said at least one resistance element is connected to at least one of said plurality of flanges extending upward from a rear end of said base.

9. The exercise chair of claim 1, wherein at least one said resistance element is a tension spring.

10. The exercise chair of claim 1, wherein at least one said resistance element is detachably connected to said rear portion of said seat support and to said back support.

11. The exercise chair of claim 1, wherein said seat support includes a base and a plurality of flanges defined at a front end of said base, wherein said plurality of flanges and said angled section include at least one hole defined therethrough; further comprising a rod extending through said at least one hole defined through said plurality of flanges and said angled section about which said base is rotatable.

12. The exercise chair of claim 1, wherein at least one said resistance element includes a hook at an end thereof.

13. The exercise chair of claim 1, wherein at least one said resistance element includes a closed loop at an end thereof.

14. The exercise chair of claim 1, wherein said seat support is connected to said frame in proximity to the upper end of said angled section.

15. The exercise chair of claim 1, further comprising arms connected to said frame.

16. The exercise chair of claim 1, further comprising a leg assembly connected to said frame.

17. A method of performing exercise using an exercise chair in conjunction with a workpiece work surface comprising:

possessing an exercise chair comprising a frame, comprising a base, an angled section angled upward from a front of said base, and a back support extending upward from a rear of said base;

a seat support rotatably connected to said angled section; and at least one resistance element connected to a rear portion of said seat support and to said back support moving said exercise chair into proximity with the workpiece work surface;

connecting at least one said resistance element to said exercise chair;

sitting in a seat of said exercise chair; and moving said seat up and down by exertion of the user.

18. The method of claim 17, further comprising performing said exercising while performing work on the workpiece work surface.

19. The method of claim 17, further comprising disconnecting said at least one resistance element from said exercise chair.

20. The method of claim 17, further comprising locking said seat support relative to said frame.

* * * * *